US010028574B2

(12) United States Patent
Rennette

(10) Patent No.: US 10,028,574 B2
(45) Date of Patent: Jul. 24, 2018

(54) HAIR STYLING BRUSH SYSTEMS

(71) Applicant: Jean Rennette, Walnut Creek, CA (US)

(72) Inventor: Jean Rennette, Walnut Creek, CA (US)

(73) Assignee: Olivia Garden International Inc., Walnut Creet, CA (US)

( * ) Notice: Subject to any disclaimer, the term of this patent is extended or adjusted under 35 U.S.C. 154(b) by 4 days.

(21) Appl. No.: 14/807,361

(22) Filed: Jul. 23, 2015

(65) Prior Publication Data

US 2016/0353855 A1 Dec. 8, 2016

Related U.S. Application Data

(60) Provisional application No. 62/170,615, filed on Jun. 3, 2015.

(51) Int. Cl.
*A46B 9/02* (2006.01)
*A45D 20/52* (2006.01)

(52) U.S. Cl.
CPC ..... *A46B 9/023* (2013.01); *A45D 20/52* (2013.01)

(58) Field of Classification Search
CPC ..... A45D 24/40; A45D 24/42; A45D 24/14; A45D 24/44; A45D 24/04; A45D 24/46; A45D 24/16; A45D 20/52; A45D 20/525; A46B 2200/104; A46B 3/20; A46B 7/02; A46B 7/023; A46B 7/026; A46B 15/003; A46B 7/044; A46B 9/023
See application file for complete search history.

(56) References Cited

U.S. PATENT DOCUMENTS

| | | | | |
|---|---|---|---|---|
| 1,508,059 A | | 9/1924 | Komorous | |
| 2,197,551 A | | 4/1940 | Jensen | |
| 2,202,672 A | * | 5/1940 | Fannie | A45D 2/002 132/117 |
| 2,238,603 A | | 4/1941 | Runnels | |
| 2,482,928 A | | 9/1949 | Augusta et al. | |

(Continued)

FOREIGN PATENT DOCUMENTS

| | | | |
|---|---|---|---|
| DE | 2843098 | * | 4/1980 |
| GB | 2054368 | * | 2/1981 |

OTHER PUBLICATIONS

Denman, D3 Medium 7 Row Styling Brush, Internet Web site, available at http://www.denmanbrushus.com/acatalog/Denman-D3-Medium-7-row-styling-brush.html (last visited Apr. 28, 2015).

(Continued)

*Primary Examiner* — Todd E Manahan
*Assistant Examiner* — Brianne Kalach
(74) *Attorney, Agent, or Firm* — Volk & McElroy, LLP; Michael D. Volk, Jr.

(57) ABSTRACT

A system of hair styling brushes comprising a thermal plate situated over a resilient cushion member having bristles integrated with the resilient cushion member and extending through and away from the thermal plate, with an air break, or gap, between the thermal plate and resilient cushion member. The thermal plate assists shaping, shining, and drying of hair when used with a blow dryer. Further, the thermal plate covers the elastomeric materials forming the resilient cushion member, making the elastomeric materials less susceptible to degradation.

18 Claims, 9 Drawing Sheets

(56) References Cited

U.S. PATENT DOCUMENTS

| | | | | |
|---|---|---|---|---|
| 2,730,747 | A * | 1/1956 | Bressler | A46B 5/0025 15/201 |
| 2,916,757 | A | 12/1959 | Peilet et al. | |
| 3,766,590 | A | 10/1973 | Wachtel | |
| 4,118,823 | A | 10/1978 | Axelrod | |
| 4,217,915 | A | 8/1980 | Gress et al. | |
| D263,768 | S | 4/1982 | Birch | |
| D286,469 | S | 11/1986 | Arciero | |
| 5,600,865 | A * | 2/1997 | Morrison | A46B 17/06 119/628 |
| 5,862,563 | A * | 1/1999 | Hartmann | A46B 17/06 119/628 |
| 6,092,256 | A | 7/2000 | Chen | |
| 6,421,872 | B1 | 7/2002 | Sciandivasci | |
| 6,681,435 | B2 * | 1/2004 | Wang | A46B 9/023 132/120 |
| 7,526,829 | B2 | 5/2009 | Chang et al. | |
| 8,302,246 | B2 | 11/2012 | Chudzik et al. | |
| 2004/0088812 | A1 | 5/2004 | Weihrauch | |
| 2004/0255967 | A1 * | 12/2004 | White | A45D 20/525 132/120 |
| 2005/0121049 | A1 * | 6/2005 | Rizzuto, Jr. | A45D 24/00 132/147 |
| 2009/0000049 | A1 * | 1/2009 | Liao | A46B 5/0033 15/185 |
| 2009/0188062 | A1 | 7/2009 | Chudzik et al. | |
| 2009/0229624 | A1 * | 9/2009 | Purvis | A46B 15/0091 132/120 |
| 2014/0332023 | A1 | 11/2014 | Kaizuka | |

OTHER PUBLICATIONS

Patent Cooperation Treat International Search Report for Hair Styling Brush Systems, Application PCT /US16/35696 (PCT corresponding to application).

* cited by examiner

HAIR STYLING BRUSH SYSTEMS

CROSS-REFERENCE TO RELATED APPLICATIONS

This application claims the benefit of U.S. Provisional Application No. 62/170,615, filed Jun. 3, 2015, entitled "Hair Styling Brush Systems", which is hereby incorporated by reference in its entirety.

DETAILED DESCRIPTION

The embodiments disclosed herein relate to improved hair styling brush systems. Professional hairstylists worldwide routinely employ a set tools considered essential to the shaping and styling of hair. Foremost among these are hair styling brushes, or hair brushes, and hand-held, electrically-heated "hairdryers", also known as "blow dryers". In the art of hairstyling, the hair styling brush is used to manipulate the hair as a flow of heated air generated by the hairdryer assists in setting the shape of the individual's hair.

Generally speaking, the hair brushes of the present disclosure comprise a plurality of bristles mounted within a resilient cushion member. The cushion member is engaged within a brush head portion that is joined to a hand-graspable handle. Additionally, the hair brushes of the present disclosure utilize at least one heat retention plate, or thermal plate, above and covering the resilient cushion member to assist shaping, shining, and drying of hair when the heat retention plate is heated with a blow dryer and placed in contact with hair during hair styling. The hair brushes of the present disclosure also utilize a gap between the heat retention plate and the resilient cushion member. In use, the hair brushes of the present disclosure provide a user with greater thermal control during hairstyling procedures using heated air.

Figure 19:
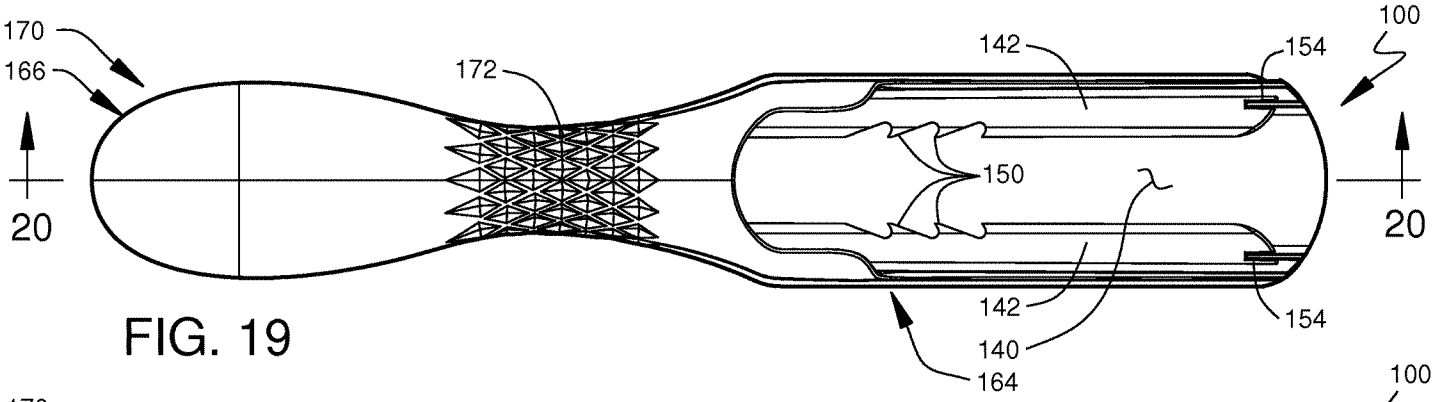
FIG. 19 shows a top view illustrating a brush head portion and handle of a hair brush according to another example implementation of the present disclosure.
Figure 20:
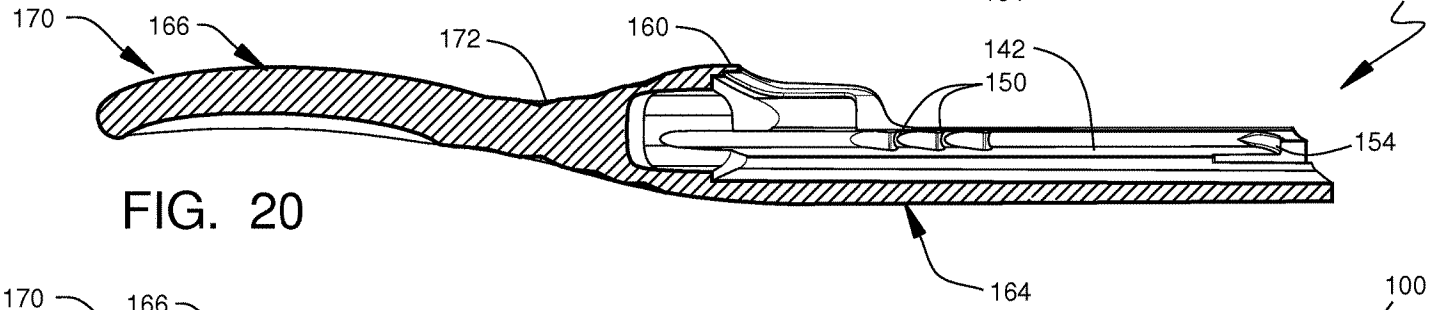
FIG. 20 shows a sectional view through the longitudinal section 20-20 of FIG. 19 illustrating various internal and external features of the brush head portion and handle of the hair brush of FIG. 19.
Figure 21:
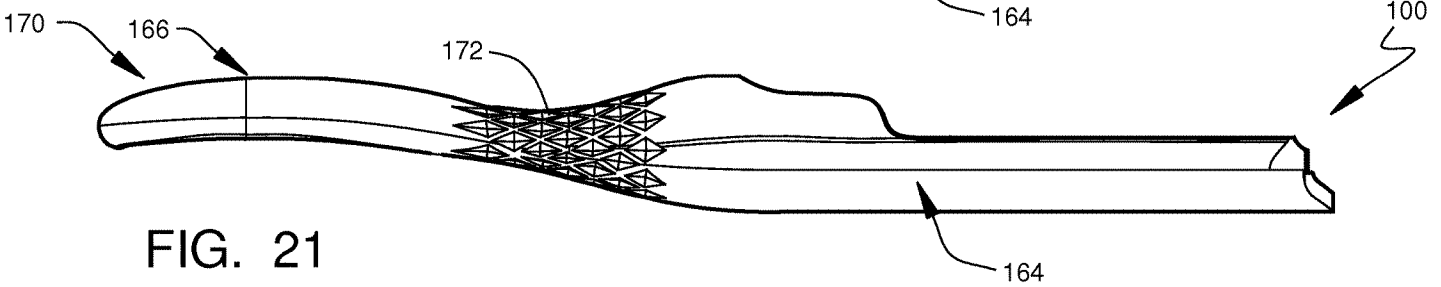
FIG. 21 shows a side view further illustrating various features of the brush head portion and handle of the hair brush of FIG. 19.

The concepts disclosed in the present disclosure may be implemented in a number of ways. One example implementation is illustrated in FIGS. 1-18. Another example implementation is illustrated in FIGS. 19-21. It is noted that while a particular brush shape is depicted and described in the figures, other brush shapes are envisioned, such as, for example, rectangular-shaped paddle brushes, oval-shaped brushes, etc.

Figure 2:
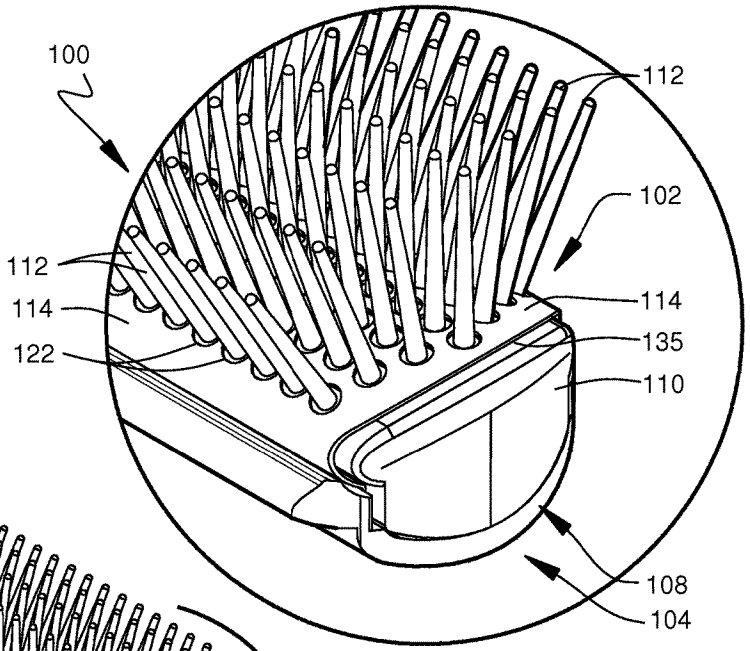
FIG. 2 shows an enlarged partial perspective view of the brush head portion of the hair brush of FIG. 1.
Figure 1:
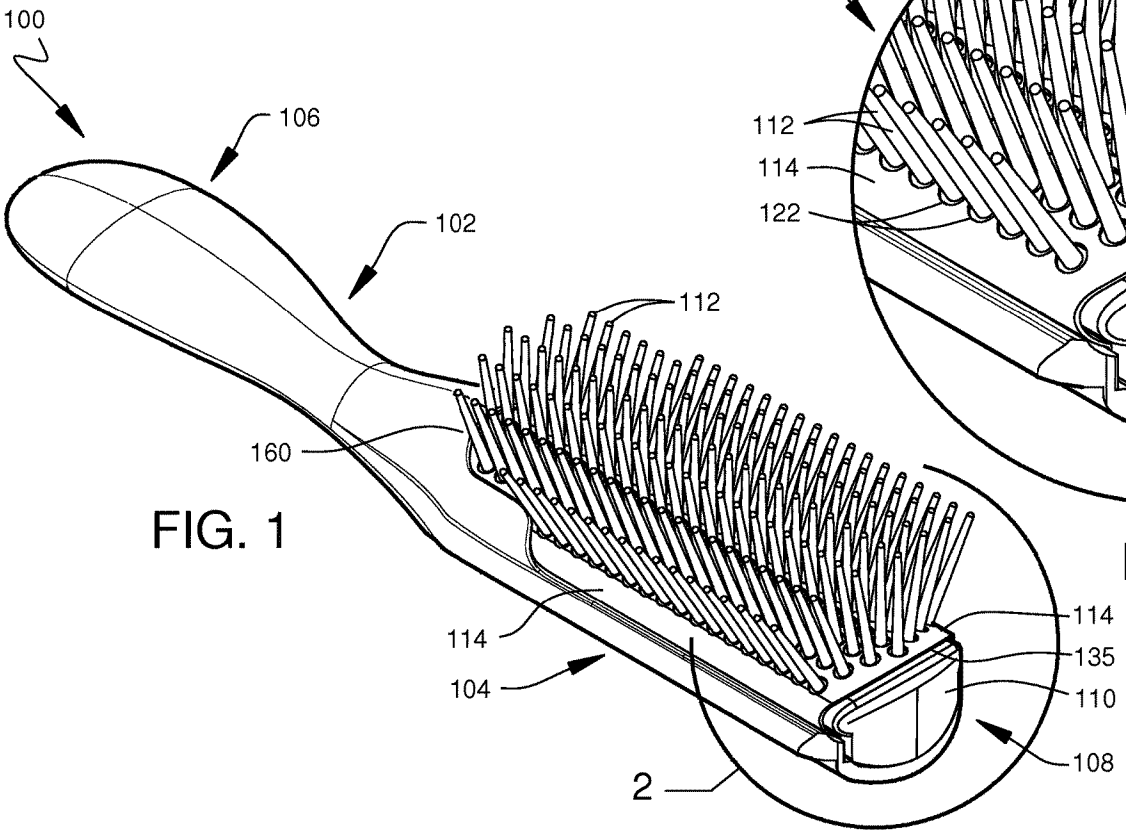
FIG. 1 shows a perspective view illustrating an example implementation of a hair of the present disclosure.
Figure 3:
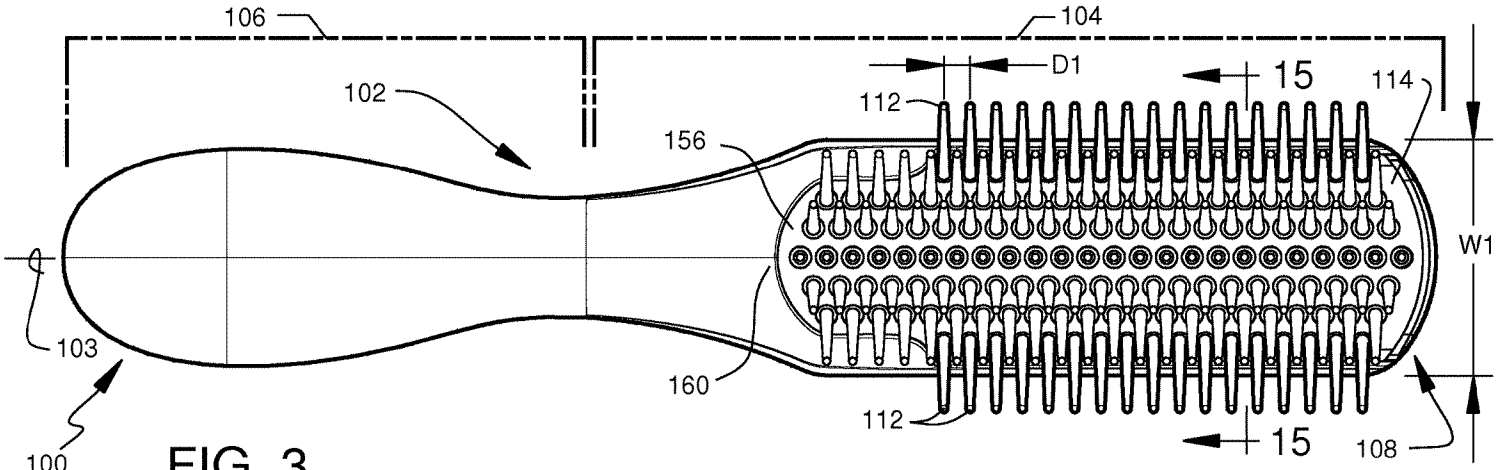
FIG. 3 shows a top view of the hair brush of FIG. 1.
Figure 4:
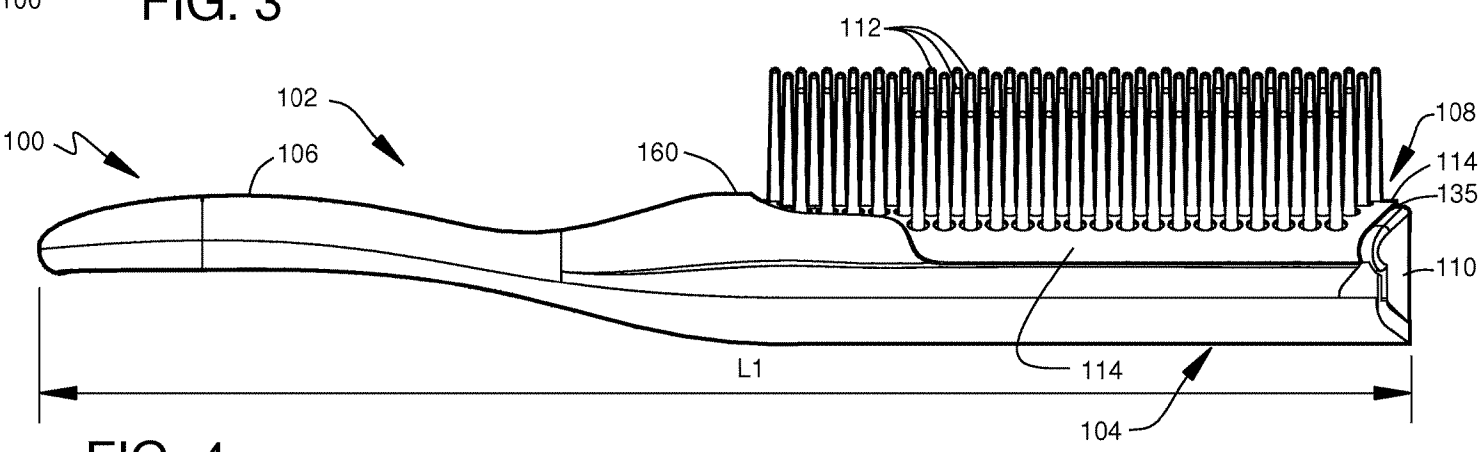
FIG. 4 shows a side view of the hair brush of FIG. 1.

FIG. 1 shows a perspective view, illustrating hair brush 102, according to an embodiment of the present disclosure. FIG. 2 shows an enlarged partial perspective view illustrating brush head portion 104 of hair brush 102. FIG. 3 shows a top view of hair brush 102. FIG. 4 shows a side view of hair brush 102. Hair brush 102 is one of a number of embodiments or implementations of hair brush system 100. One key feature of the hair brushes of hair brush system 100 is that they comprise a thermal plate to enhance the performance of the hair brush during use and to increase the durability of the components of the hair brush. The thermal plate, also referred to herein as a heat retention plate, assists shaping, shining, and drying of hair when heat is applied to the thermal plate using a blow dryer or similar device. The thermal plate advantages are numerous. The thermal plate allows shaping the hair (e.g., straightening, curling, giving a texture-wave effect, etc.) much more easily depending on how the brush is used on the hair. The thermal plate also substantially reduces blow drying time when blow drying the hair as the hot thermal plate contacting the hair causes the hair to dry faster. The thermal plate further lends more shine to the hair. When the scales on the surface of the hair are smoothed, or closed, by dragging the hot thermal plate in the direction of the scale closing (i.e., brushing the hair from root to the ends), the "closed" scales result in a smoother surface which reflects light creating a shiny appearance. Shiny hair is desirable as it portrays a beautiful and healthy look. The thermal plate further improves the durability of the hair brush through reductions in the rates of thermal degradation within the constituent materials.

With reference to FIG. 1 and FIG. 2, hair brush 102 is depicted as a hand-held device for grooming and styling of hair. Hair brush 102 may be thought of as made up of three principal parts identified herein as handle portion 106, brush head portion 104, and bristle assembly 108, as shown.

Bristle assembly 108 comprises cushion member 110, thermal plate member 114 (also referred to herein as plate member 114 and also embodying herein a heat retention plate), and a plurality of bristles 112, as shown. It is noted that reference numerals identifying individual bristles 112 within drawings shall refer to like elements throughout. Bristle assembly 108 is depicted as able to be inserted into brush head portion 104, as best shown in the partially exploded view of FIG. 16. Bristles 112 of bristle assembly 108 project outwardly from cushion member 110, as shown. In an example implementation, cushion member 110 is constructed from a resilient material having rubber-like properties.

In an example implementation, plate member 114 comprises a thin but rigid shell-like structure that fits over the portion of cushion member 110 containing bristles 112, as shown. Plate member 114 comprises an arrangement of apertures 122 through which bristles 112 outwardly project, as shown. Plate member 114 provides the advantages noted above and protectively covers portions of cushion member 110 that are most directly exposed to flows of heated air from a hairdryer during use. Without thermal plate member 114, cushion member 110 would be exposed and would make contact with the hair not providing the noted advantages of the thermal plate. In the example implementation of FIG. 1, plate member 114 is shown covering the upper surface of cushion member 110; cushion member is shown exposed at the top-end portion of brush head portion 104. The amount of covering that plate member 114 provides cushion member 110 may differ from the implementation depicted in FIG. 1. For example, thermal plate may cover the entire cushion member including the top-end portion, thermal plate may cover a portion less than that depicted in FIG. 1 exposing one or more areas of the upper surface of the cushion member, etc.

Bristles 112 may be arranged in linear rows as shown, for example, in FIG. 3. In such an example implementation, within each linear row, bristles 112 may be evenly spaced at a bristle-to-bristle distance D1 of about 4 millimeters. Those with skill in the art will understand that the spacing between bristles may be altered. Bristles 112 of adjacent rows may be arranged in a staggered pattern, as shown in the top view of FIG. 3 and the side view of FIG. 4.

In one example implementation, hair brush 102 may have a longitudinal length L1 of about 210 millimeters and a maximum transverse width W1 at brush head portion 104 of about 36 millimeters. It is noted that this length and width may be altered to provide hair brushes of different sizes. Further, as noted above, hair brushes made according to the teachings of the present disclosure may be implemented in a number of different shapes.

In an example implementation, bristles 112 of bristle assembly 108 may be arranged in seven spaced-apart rows that are generally oriented in parallel alignment with the longitudinal axis 103, as shown. In one of the various implementations of hair brush system 100, a smaller five-row arrangement of bristles may be implemented. In yet another of the various implementations of hair brush system 100, a larger nine-row arrangement of bristles may be implemented. In still other various implementations of the hair brush system 100, other numbers of rows of bristles or bristle arrangements may suffice.

Handle 106 facilitates comfortable grasping and manual manipulation of the hair brush during use. In this regard, handle portion 106 may comprises at least one ergonomically-designed graspable shape, as shown. The smoothly-tapered "teardrop" profile depicted in FIG. 3 is one of the various implementations of a handle configuration of a hair brush of hair brush system 100.

Figure 6:
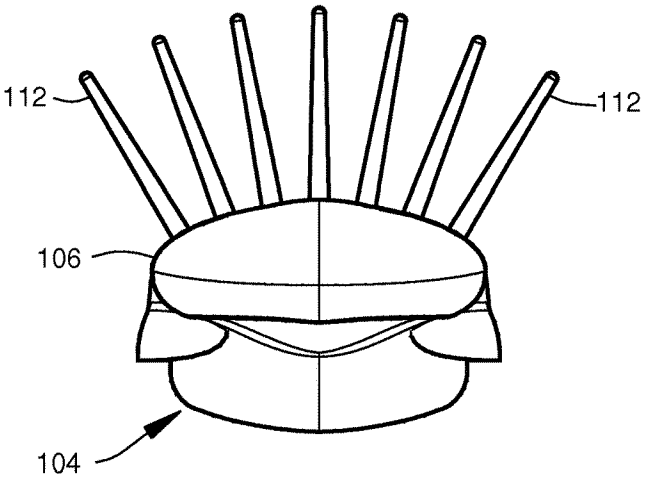
FIG. 6 shows a back-end view of the hair brush of FIG. 1.
Figure 5:
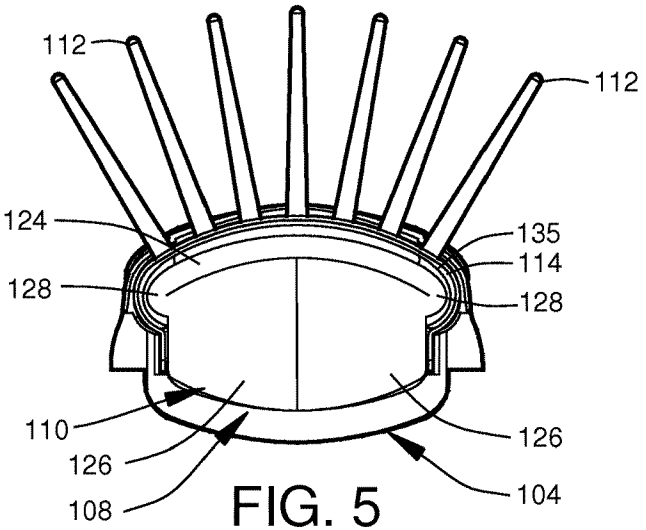
FIG. 5 shows a front-end view of the hair brush of FIG. 1.

FIG. 5 shows a back-end view of hair brush 102 and FIG. 6 shows a front-end view of hair brush 102. Referring to the illustrations of FIG. 5 and FIG. 6, both cushion member 110 and the thermal plate member 114 comprise a rounded convex profile when assembled within brush head portion 104, as shown. The rounded convex profiles of cushion member 110 and the thermal plate member 114 assist in maintaining gap 135 discussed further below. The rounded convex profile is further beneficial in facilitating the execution of hair styling techniques. In various implementations of hair brush system 100, the profile of thermal plate member and cushion member may be other than rounded convex, for example, the profile may be square-like or rectangular-like. In other various implementations of hair brush system 100, the profile of the cushion member may differ from the profile of the thermal plate so long as there is a gap maintained between the cushion member and the thermal plate member.

In the implementation depicted in FIGS. 5 and 6, the rows of bristles 112 project outwardly in an orientation generally perpendicular to the outer face of cushion member 110, as shown. Thus, the rows of bristles 112 are splayed outwardly in a radiating pattern generally following the curved outer surface of cushion member 110, as shown.

Figure 7:
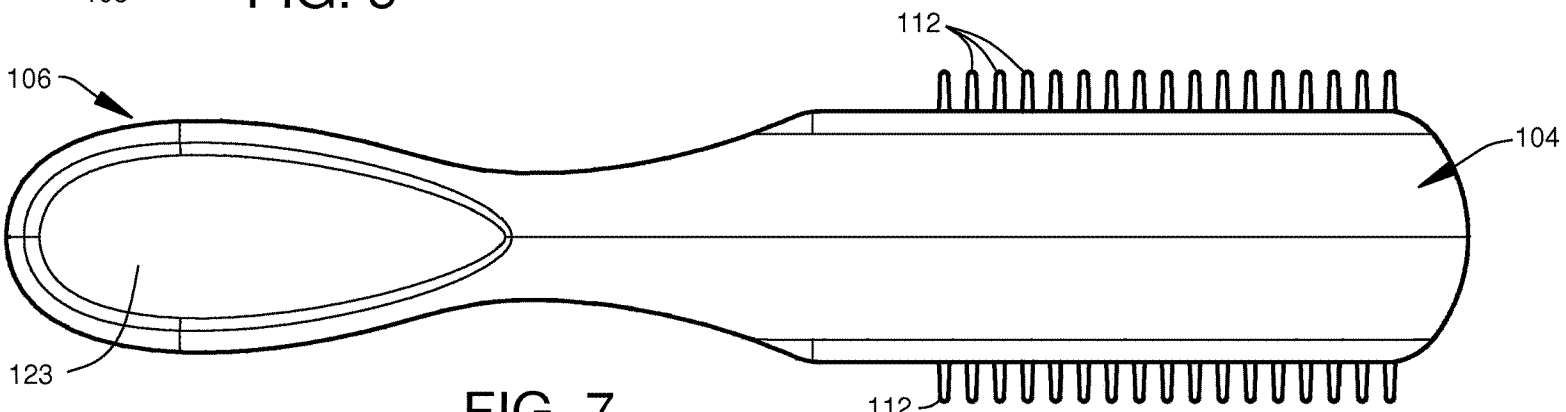
FIG. 7 shows a bottom view of the hair brush of FIG. 1.

FIG. 7 shows a bottom view of hair brush 102. The bottom view of handle portion 106 illustrates an example implementation of an optional teardrop-shaped concave region 123 formed within the bottom surface of handle portion 106, as shown. The bottom view shown in FIG. 7 illustrates that the brush head portion 104 has a closed back in an example implementation. According to other example implementations, brush head portion 104 may be oval shaped or in a rectangular paddle brush shape.

In an example implementation, handle portion 106 and brush head portion 104 may be integrally joined, as shown in FIG. 7. In an example implementation, handle portion 106 and brush head portion 104 may formed monolithically using a single material. Handle portion 106 and brush head portion 104 may be constructed from a durable and lightweight material with the substantial use of rigid plastics being an example material. Handle portion 106 and brush head portion 104 may be molded as a single unit using known injection processes. Other materials of handle portion and brush head portion such as, for example, molded rubbers, milled plastics, vacuum-formed materials, metals, wood, glass, carbon-fiber, etc., and any combination of the foregoing, may suffice. Further, other assembly techniques, such as, assemblies formed by joining together two or more pre-molded parts, co-molding a resilient material over a rigid plastic substrate, etc., may suffice.

Figure 8:
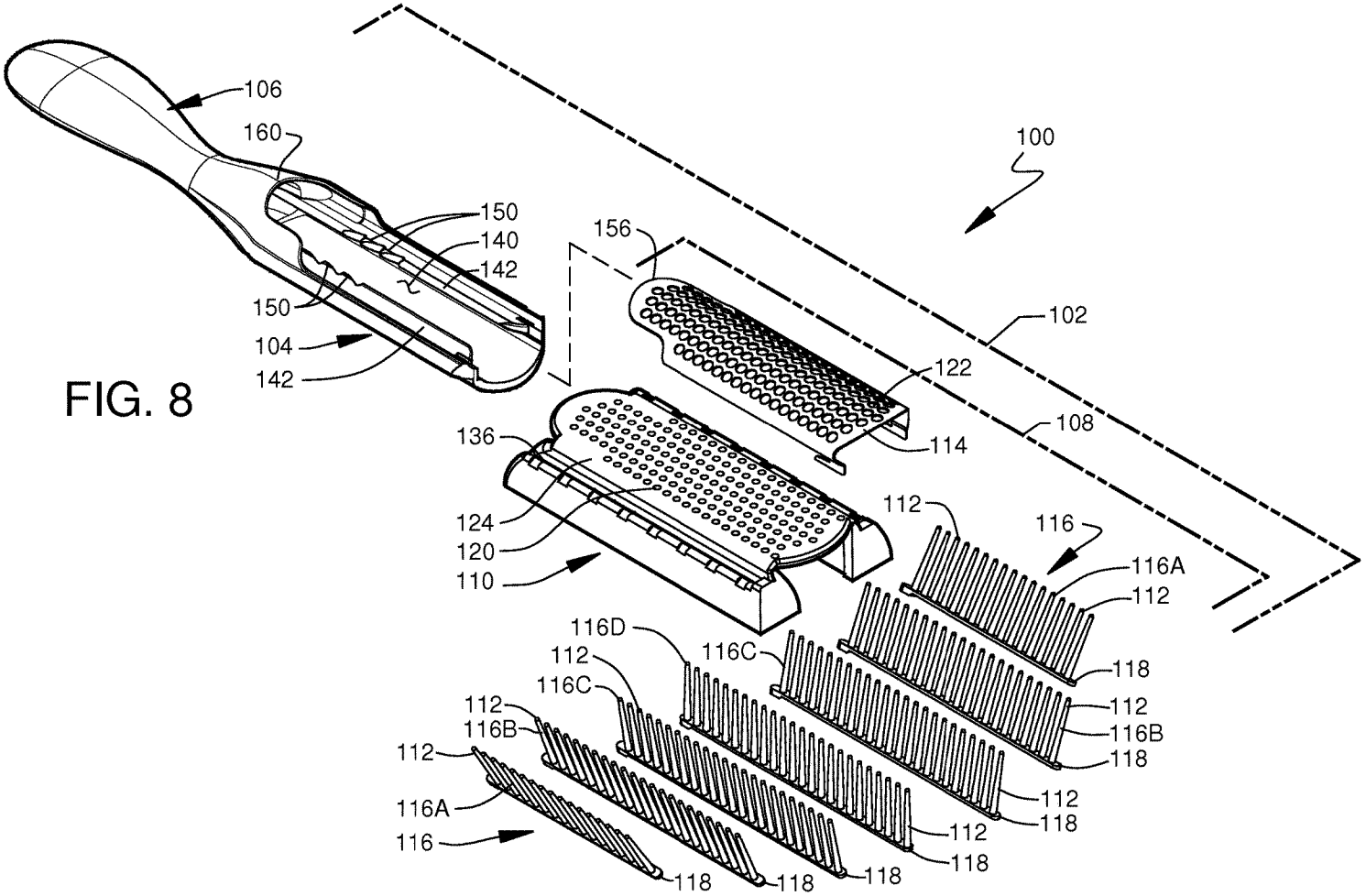
FIG. 8 shows an exploded view illustrating various subcomponents of the hair brush of FIG. 1.

FIG. 8 shows an exploded view, illustrating various subcomponents of hair brush 102. FIG. 8 depicts hair brush 102 in a fully disassembled configuration. Visible in the exploded view of FIG. 8 is brush head portion 104, handle portion 106, and bristle assembly 108. Bristle assembly 108 is further subdivided into cushion member 110, bristles 112, and plate member 114, as shown.

In an example implementation, bristles 112 may be organized into separate bristle bars 116, as shown. In the example implementation illustrated in FIG. 8, 196 individual bristles 112 are shown grouped to form seven separate bristle bars 116. Each bristle bar 116 is shown to have a selected number of bristles 112 joined together by a continuous elongated base member 118, as shown. Bristle bars 116 may contain differing numbers of bristles 112 to accommodate the contoured shape of bristle assembly 108. As illustrated in FIG. 8, the two outermost opposing bristle bars 116A each contain 17 individual bristles 112. Inward of these are two longer bristle bars 116B, each one comprising 22 bristles 112, as shown. Inward of these are two additional bristle bars 116C, each one comprising 23 separate bristles 112, as shown. The central bristle bar 116D is the longest of the seven bars containing 24 bristles 112, as shown. Those with skill in the art will understand that, under appropriate circumstances, other arrangements of bristles and bristle bars may suffice.

In an example implementation, positioning of the bristle bars 116 within brush head portion 104 is controlled by cushion member 110. In an example implementation, cushion member 110 comprises an arrangement of perforations 120 into which the bristles of the previously-described bristle bars 116 are preferably engaged or integrated. It is noted that reference numerals identifying individual perforations 120 within drawings shall refer to like elements throughout.

Cushion member 110 in FIG. 8 is shown in an unfolded configuration that allows access to perforations 120 for placement of the bristles of bristle bars 116 therein. Once the bristles of bristle bars 116 are engaged within perforations 120, cushion member 110 is folded to allow the assembly to be inserted within brush head portion 104, as will be explained in greater detail herein.

In an example implementation, brush head portion 104 has a hollow interior cavity 140 to receive cushion member 110. Interior cavity 140 is depicted equipped with a set of structures designed to position and retain bristle assembly 108 within brush head portion 104. To this end, interior cavity 140 is shown with a pair of retention rails 142 located respectively along the interior side walls of interior cavity 140, as shown.

Figure 9:
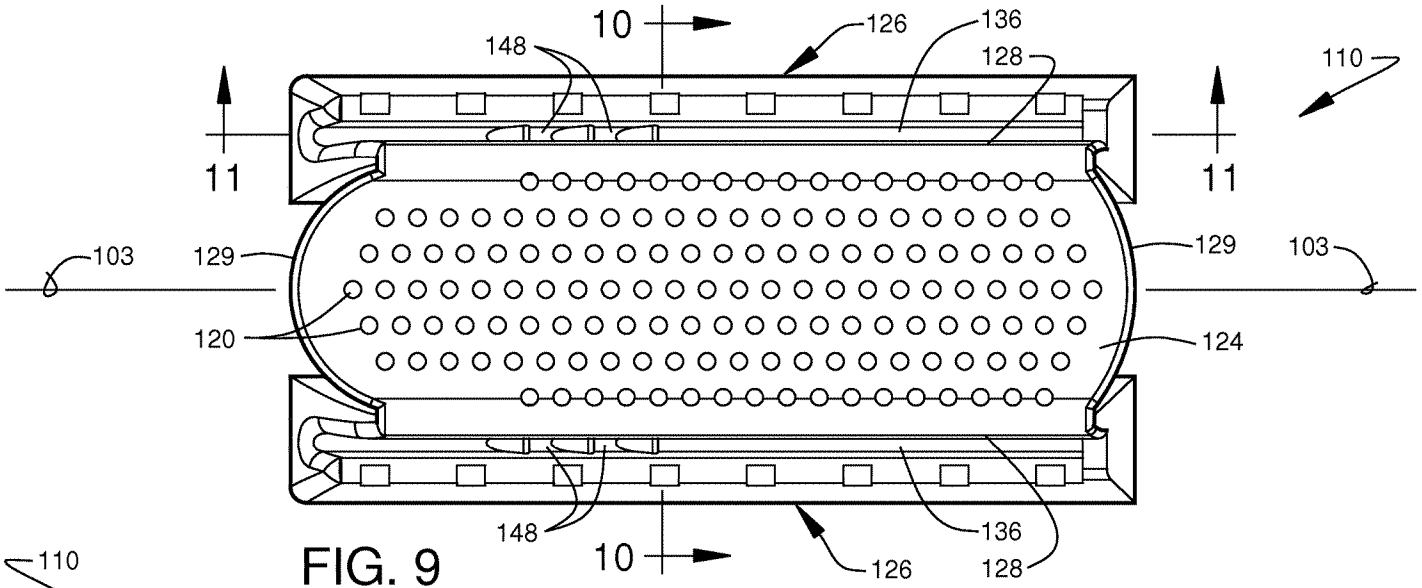
FIG. 9 shows a top view illustrating various features of a bristle-supporting cushion member of the hair brush of FIG. 1.
Figure 11:
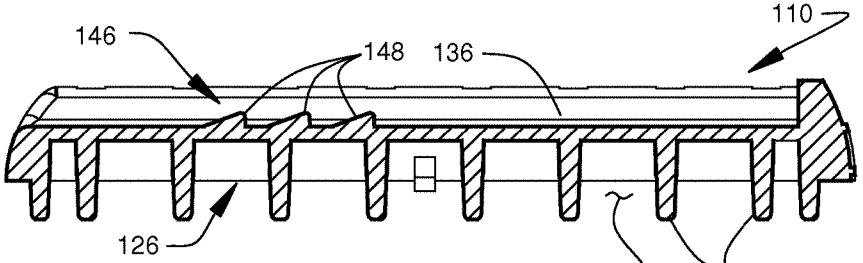
FIG. 11 shows a sectional view through the longitudinal section 11-11 of FIG. 9 further illustrating various features of the bristle-supporting cushion member of FIG. 9.
Figure 10:
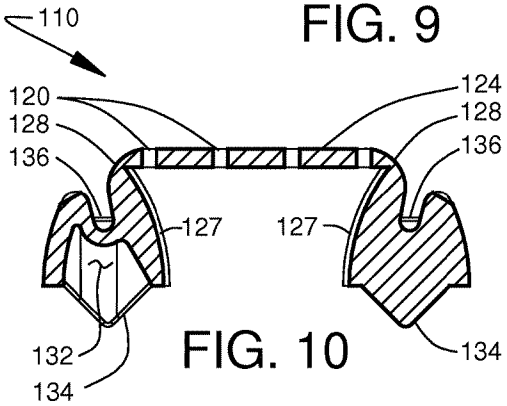
FIG. 10 shows a sectional view through the transverse section 10-10 of FIG. 9 illustrating various features of the bristle-supporting cushion member of FIG. 9.

FIG. 9 through FIG. 11 further illustrate various features and arrangements of an example implementation of cushion member 110. FIG. 9 shows a top view of cushion member 110. FIG. 10 shows a sectional view through the transverse section 10-10 of FIG. 9. FIG. 11 shows a sectional view through the longitudinal section 11-11 of FIG. 9. In reference to FIG. 9 through FIG. 11 and with continued reference to FIG. 8, perforations 120 (also referred to herein as apertures) within cushion member 110 may be arranged in longitudinal rows, with each longitudinal row configured to accommodate bristles from a single bristle bar 116. Such a structure and arrangement permits the bristles to flex at the base of the cushion member. In total, the example cushion member 110 illustrated in FIGS. 9-11 comprises 196 of perforations 120 to accommodate the 196 bristles 112 contained within the seven individual bristle bars 116 noted above. It is noted that the number of perforations may be increased or decreased. Corresponding perforations, or apertures, should be present in the thermal plate for passage of bristles.

In the present example implementation of hair brush system 100 illustrated in FIG. 9-11, the central portion of cushion member 110, containing perforations 120, is shown to have an elongated portion, generally identified herein as bristle support member 124. Cushion member 110 is shown with a set of opposing arcuate ends 129 and an opposing pair of block-like side members 126 flanking each long edge of bristle support member 124.

In an example implementation, each side member 126 is joined integrally with bristle support member 124 by a continuous "living" hinge 128 that is arranged in parallel orientation to longitudinal axis 103, as shown. Together, bristle support member 124, side members 126 and living hinges 128 form cushion member 110. Bristle support member 124, side members 126, and living hinges 128 may be molded as a single unitary structure.

Figures 12, 13:
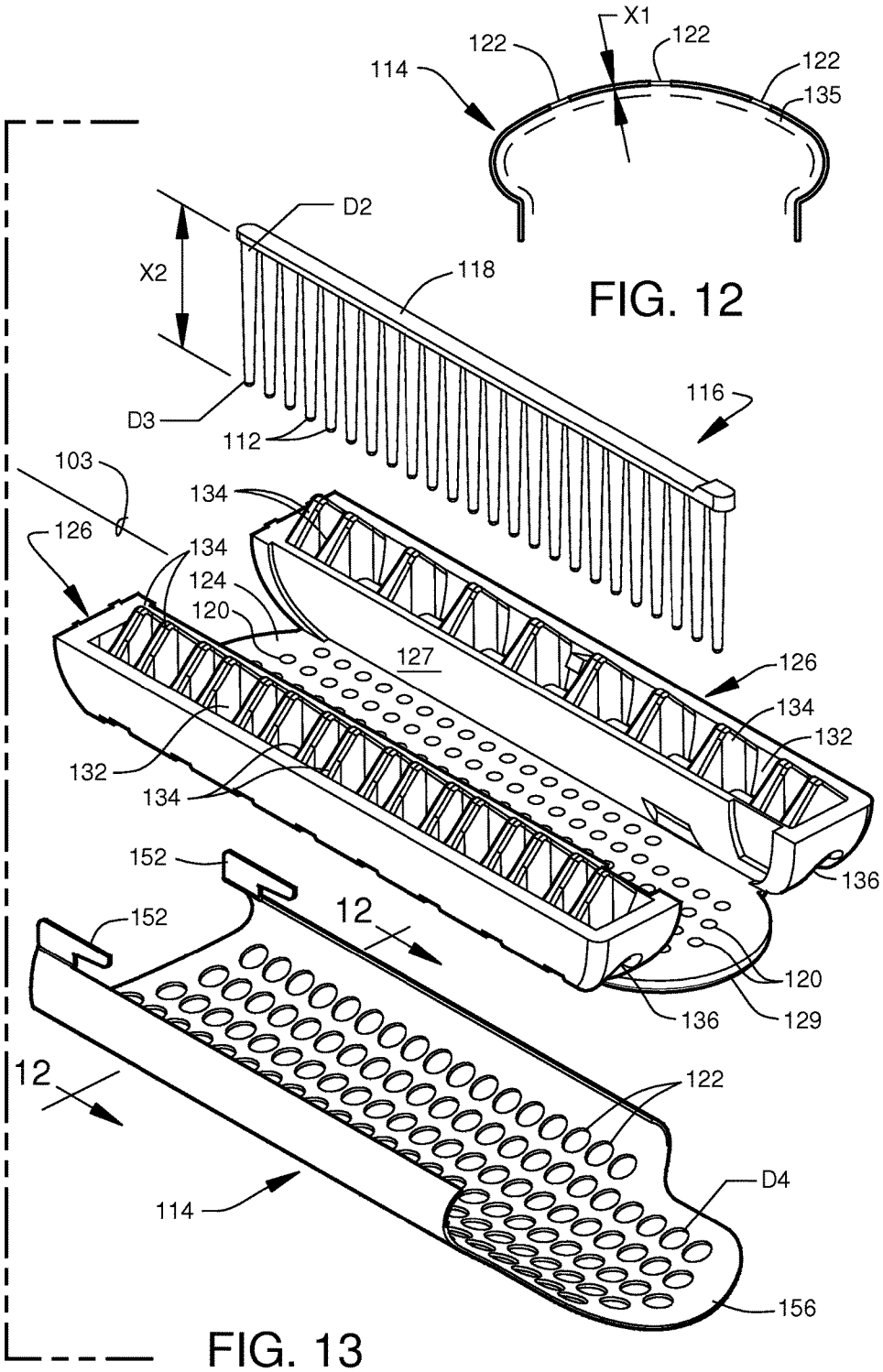
FIG. 12 shows a sectional view through the transverse section 12-12 of FIG. 13 illustrating a thermal plate member of the hair brush of FIG. 1.
FIG. 13 shows an exploded perspective view illustrating various subcomponents of the brush head portion of the hair brush of FIG. 1.

The lower portion of each side member 126 is shown comprising a hollow channel 132 extending the length of the member (see also FIG. 13). The interior of each channel 132 is shown populated with an arrangement of projecting ribs 134 oriented substantially perpendicular to longitudinal axis 103 (see also FIG. 13). These sets of projecting ribs 134 interlock when the two side members 126 are brought together as cushion member 110 is folded, as will be described in greater detail in FIG. 14.

With specific reference to FIG. 9 and FIG. 10, the upper portion of each side member 126 is shown with a continuous recessed channel 136 extending substantially the length of the member, as shown. Recessed channel 136 is shown arranged in parallel orientation to longitudinal axis 103, as shown. Each recessed channel 136 engages a respective retention rail 142 located along the interior sides of interior cavity 140 of brush head portion 104 (see FIG. 8). When cushion member 110 is folded, the two opposing recessed channels 136 are positioned and aligned to enable bristle assembly 108 to slidably engage retention rails 142.

In an example implementation, each recessed channel 136 further comprises one half of an interlocking retainer 146 designed to assist in retaining bristle assembly 108 within brush head portion 104. Interlocking retainer 146 is shown with a first plurality of outwardly projecting teeth 148 longitudinally disposed within recessed channel 136. A second plurality of teeth 150 are shown longitudinally disposed on each retention rail 142 (see again FIG. 8). In the depicted implementation, teeth 148 and teeth 150 have a saw tooth shape enabling teeth 148 and teeth 150 to interlock, in a ratchet-type fashion, when recessed channels 136 are engaged on retention rails 142. Those of ordinary skill in the art will appreciate that teeth 148 and teeth 150 could be of different shapes and profile, such as rounded or square, so long as the "teeth" can be placed in interlocking relationship. Interlocking retainer 146 is configured to retain bristle assembly 108 within brush head portion 104. Such arrangement at least embodies herein a cushion-member-to-brush-head-portion locking system.

FIG. 12 shows a sectional view, through the transverse section 12-12 of FIG. 13, illustrating the sectional profile of thermal plate member. FIG. 13 shows a perspective view illustrating various subcomponents of brush head portion 104. In FIG. 13, the subcomponents of bristle assembly 108 have been rotated, relative to the view of FIG. 8, to show the opposing (lower) surface structures of the constituent components. For clarity of description, only a single bristle bar 116 is shown in FIG. 13.

Figure 14:
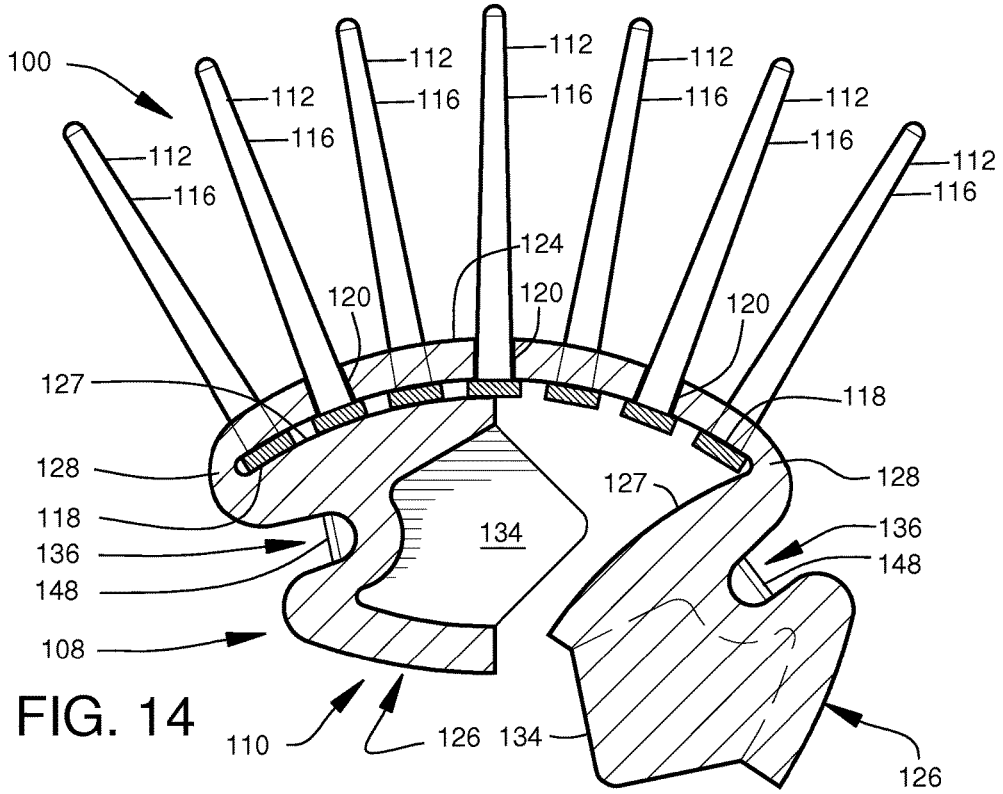
FIG. 14 shows a sectional view extending transversely through a partially assembled bristle-supporting cushion member illustrating the cushion member of the hair brush of FIG. 1 in a partially folded configuration.
Figure 15:
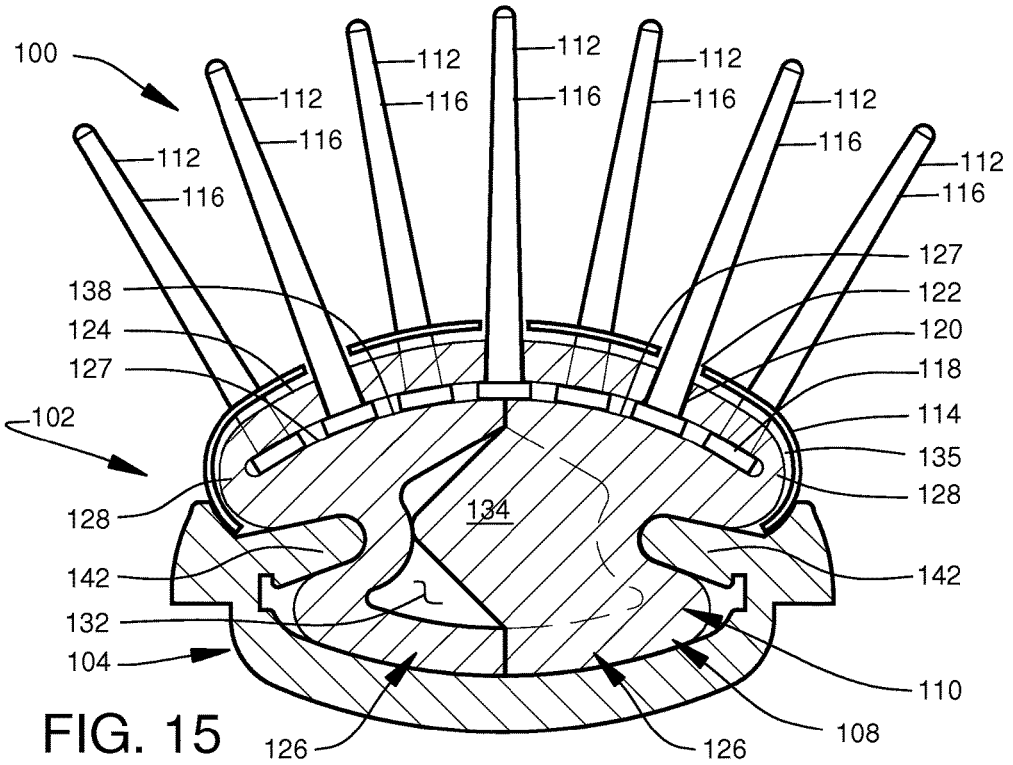
FIG. 15 shows a sectional view through the transverse section 15-15 of FIG. 3 illustrating the assembled brush head of the hair brush of FIG. 1.

In reference to FIG. 12, according to an example implementation hereof, thermal plate member 114 comprises a relatively thin "shell-like" structure having a cross-sectional profile closely matching that of cushion member 110 when cushion member 110 is in the folded configuration (see also FIG. 14 and FIG. 15). Thermal plate member 114 provides heat to hair when hair is placed in proximity of the thermal plate member (when also applying heat to the brush with a blow dryer) and to protectively cover the outer portions of cushion member 110 that are most directly exposed to flows of heated air from a hairdryer, namely, bristle support member 124. In such an implementation, thermal plate member 114 limits the volume of heated air reaching the outer surface of cushion member 110 when the apparatus is used with a hair dryer.

Thermal plate member 114 is preferably constructed from a material having high thermal conductivity. Thermally conductivity materials suitable for use in the construction of plate member 114 include metals and ceramics, including ceramic coatings. In an example implementation, plate member 114 is constructed from a metallic material. Preferred metallic materials include aluminum and copper. Steel may also be used to construct thermal plate member 114. In implementations of the hair brush of the present disclosure, a physical air gap 135 is located between the underside of the plate member 114 and outer surface of cushion member 110 (see also FIG. 15). The metallic, or similar, material forming the plate allows for greater thermal control during hairstyling procedures using heated air.

The thickness of the metallic material forming plate member 114 depends on the material selection. In an example implementation, the metallic material forming plate member 114 comprises an aluminum alloy having a thickness X1 of about 0.4 millimeters.

In an example implementation, the metallic material forming plate member 114 may have a corrosion-resistant finish. Such finishes may include plating, anodizing, painting, or a protective coating including ceramic coatings imparting ions or ionically-charged molecules to the hair. Upon reading the teachings of this specification, those of ordinary skill in the art will now understand that, under appropriate circumstances, other materials, such as, for example, cermets, polymer-graphite composites, thermally conductive polysulfone compounds, etc., may suffice.

In an example implementation, apertures 122 of plate member 114 may be arranged in positions complementary to perforations 120 of cushion member 110. In total, plate member 114 shown comprises 196 apertures 122 to accommodate the 196 bristles 112 contained within the seven previously noted bristle bars 116. In the presently discussed example implementation, each aperture 122 may have a diameter D4 of about 3.3 millimeters.

FIG. 14 shows a sectional view extending transversely through cushion member 110 illustrating cushion member 110 in a partially assembled and folded configuration. Visible in FIG. 14 are side members 126, central bristle support member 124, living hinges 128, and bristle bars 116. Bristle assembly 108 may be assembled by first engaging the plurality of bristle bars 116 within perforations 120 of bristle support member 124. Subsequently, side members 126 are folded under bristle support member 124 to capture and resiliently support the plurality of bristle bars 116 engaged therein. The folds within cushion member 110 occur along living hinges 128, as shown.

FIG. 15 shows a sectional view, through the section 15-15 of FIG. 3, illustrating the completed bristle assembly 108 engaged within brush head portion 104 of hair brush 102. In the assembled apparatus shown, the two side members 126 of cushion member 110 are brought into contact resulting in the inter-engagement of the opposing sets of projecting ribs 134, as shown. The two arcuate interior surfaces 127 of side members 126 together form a concave surface 138 that pushes against base members 118 of bristle bars 116 to firmly hold the bars in place, as shown.

In an example implementation, plate member 114 is located in a protective position above cushion member 110 and is preferably configured to provide gap 135 between the underside of plate member 114 and outer surface of cushion member 110, as shown. Gap 135 serves as a thermal break between the thermally-conductive metallic composition of plate member 114 and the elastomeric material forming cushion member 110. Among other advantages, gap 135 reduces thermal degradation of the cushion material.

Referring to the illustrations of FIG. 13 through FIG. 15, each bristle 112 takes the form of a slender peg projecting outwardly from the linear base member 118, as shown. In an example implementation, each bristle 112 may comprise a projecting length X2 of about 20.5 millimeters. In an example implementation the peg-like bristles 112 have a substantially cylindrical cross-section which tapers approaching the distal end, as shown. In an example implementation, each bristle 112 may comprise a proximal diameter D2 of about 2 millimeters and a distal diameter D3 of about 1.12 millimeters. The distal ends of bristles 112 may comprise a smooth hemispherical shape to ensure user comfort during use.

Bristles 112 may be fabricated from a durable heat and chemical resistant material having a firm to rigid mechanical resiliency. Example materials include synthetic resins and similar polymeric materials such as nylon (polyamide), nylon blends, HDPE (high-density polyethylene), polyester PBT (polybutylene terephthalate), and the like. Bristles 112 and base member 118 may be molded as a single unit using well-known injection processes. The injection mold tools are preferably engineered to produce smooth surfaces that do not catch the hair or damage the scalp. Upon reading the teachings of this specification, those of ordinary skill in the art will now understand that, under appropriate circumstances, other bristle arrangements, such as, for example, bristles having ball-point tips, metal pins, bristles infused with ion-releasing compounds, wooden bristles, bamboo bristles, etc., may suffice.

Applicant's use of thermal plate member 114 to thermally isolate and protect cushion member 110 expands the range of materials suitable in the construction of the resilient component. In an example implementation, cushion member 110 may be molded from a synthetic elastomer having approximately the same physical, chemical, and mechanical properties as natural rubber. Synthetic rubbers suitable for use in the fabrication of cushion member 110 may include styrene butadiene rubber (SBR), polybutadiene rubber (BR), acrylonitrile butadiene rubber (NBR), butyl rubber (IIR), ethylene propylene diene rubber (EPDM), polychloroprene rubber (CR), and polyisoprene rubber (IR). It is noted that the use of other resilient materials, including natural rubber, is possible.

In an example implementation, the plurality of peg-like bristles 112 may be engaged within bristle support member 124 by inserting the bristle bars 116 through perforations 120 from the rear portion of cushion member 110. Perforations 120 within bristle support member 124 should be at least equal in size to the base diameter D2 of bristles 112. Tapering of the bristle shafts assists in frictionally retaining the bristle bars 116 within bristle support member 124. The enlarged base members 118 of bristle bars 116 prevent the bristles from being pulled through perforations 120 during use.

Figures 16, 17, 18:
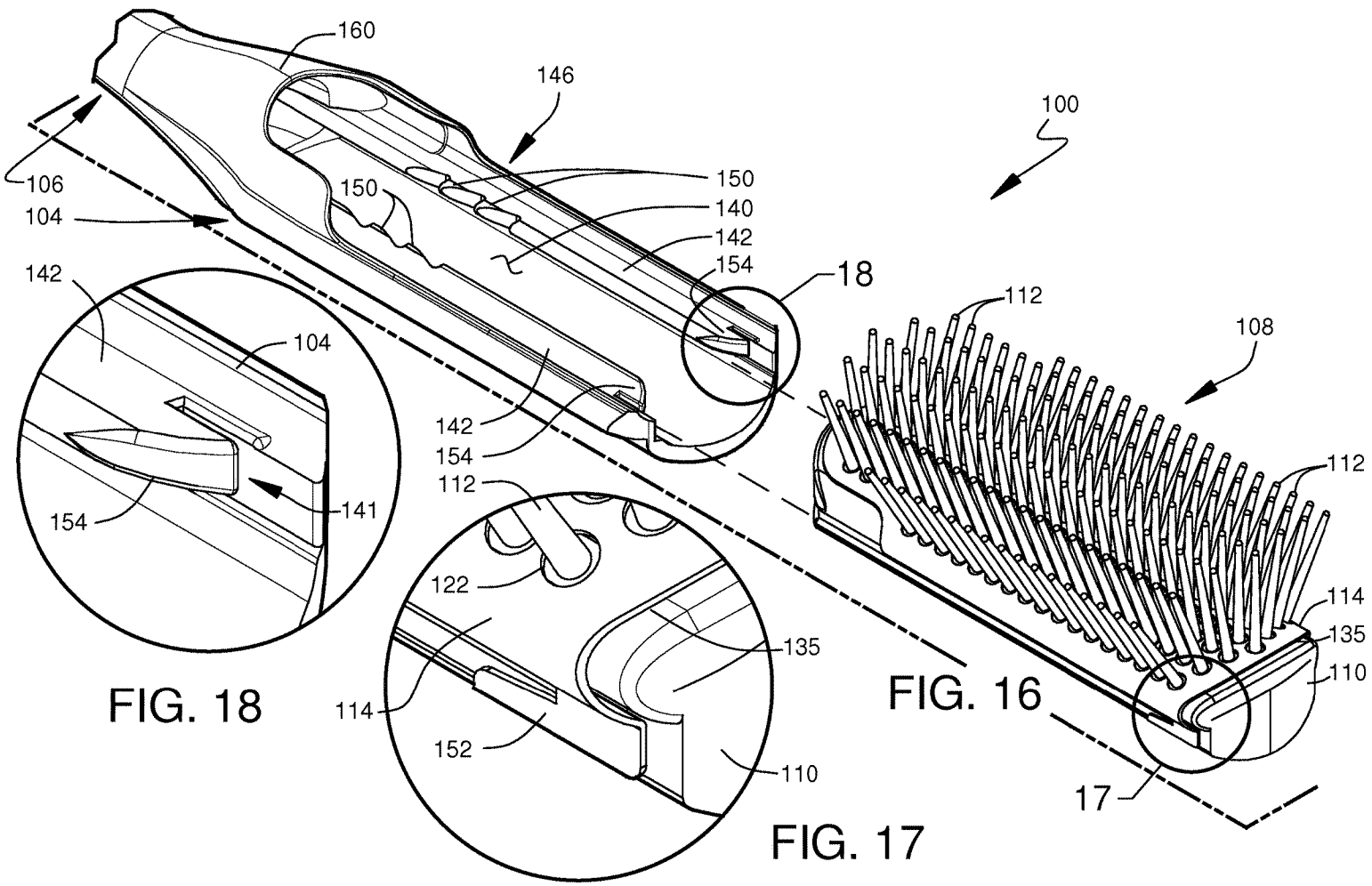
FIG. 16 shows an exploded perspective view illustrating an assembled bristle assembly in a position enabling insertion of the assembled bristle assembly into the brush head portion of the hair brush of FIG. 1.
FIG. 17 shows an enlarged partial perspective view of a locking barb of the thermal plate member of the hair brush of FIG. 1.
FIG. 18 shows an enlarged partial perspective view of a locking-barb receiver of the brush head portion of the hair brush of FIG. 1.

FIG. 16 shows an exploded view, illustrating an assembled bristle assembly 108 positioned for insertion into interior cavity 140 of brush head portion 104. In an example implementation, bristle assembly 108 is inserted into brush head portion 104 by slidably engaging recessed channels 136 on retaining side members 126 located along the sidewalls of interior cavity 140. Bristle assembly 108 is moved toward handle portion 106 until teeth 148 (see FIG. 11) and teeth 150 of locking retainer 146 are engaged.

Thermal plate member 114 is shown secured within brush head at three attachment points. FIG. 17 shows a partial perspective view, magnified for clarity, illustrating one the three attachment points. Each forward corner of plate member 114 is shown comprising a single locking barb 152 (at least embodying a slotted plate structure connect to the thermal plate and positioned beneath an uppermost surface of the thermal plate). Each locking barb 152 engages a respective one of the two locking-barb receivers 154 (at least embodying herein a slot corresponding to the slot of the slotted plate structure positioned beneath an uppermost surface of the thermal plate) located at the leading ends 141 of retention rails 142, as best shown in FIG. 18. FIG. 18 shows a partial perspective view, magnified for clarity, of one locking-barb receiver 154 of brush head portion 104. Locking-barb receiver 154 engages and captures the hook-like locking barb 152 of plate member 114. Such arrangement at least embodies herein at least one thermal-plate-to-brush-head-portion locking system. It is noted that the locking system securing thermal plate 114 in position and the locking system securing cushion member 110 in position assist to maintain gap 135 to avoid contact between thermal plate member 114 and cushion member 110. Such arrangement maintains the position of cushion member 110 and of plate member 114. It is further noted that FIG. 17 shows the slots of locking barb 152 and the slots of locking-barb-receiver 154 forming a joint wherein the planes of the slots of the locking barb 152 and that of the locking-barb-receiver 154 are in perpendicular planes. Such arrangement and connection is shown in FIGS. 16-17.

The tongue-shaped arcuate rear portion 156 of plate member 114 is preferably secured by engagement of the arcuate rear portion 156 under the central outer wall 160 of brush head portion 104. See FIG. 3. Upon reading the teachings of this specification, those of ordinary skill in the art will now understand that, under appropriate circumstances, other locking/securing arrangements, such as, for example, snap-together engagements, mechanical fasteners, spring lock devices, deformable captures, etc., may suffice.

FIG. 19 through FIG. 21 illustrate another example implementation of brush-head portion 164 and handle 166 of hair brush 170 of hair brush system 100. Hair brush 170 is substantially similar to hair brush 102, thus, only the differences will be discussed below. In this regard, FIG. 19 shows a top view, illustrating brush head portion 164 and handle 166 of hair brush 170. FIG. 20 shows a sectional view, through the longitudinal section 20-20 of FIG. 19, illustrating various internal and external features of hair brush 170. FIG. 21 shows a side view, further illustrating various external features of hair brush 170.

Within hair brush 170, the connective region between brush head portion 164 and handle 166 is shown with a textured pattern 172. Textured pattern 172 assists a user in firmly grasping the device during use. In an example implementation, textured pattern 172 comprises an arrangement of recesses arranged in a diamond-shaped pattern, as shown. Upon reading the teachings of this specification, those of ordinary skill in the art will now understand that, under appropriate circumstances, other grip patterns, such as, for example, bumps, circumferential channels, circumferential ridges, friction enhancing-coatings, etc., may suffice.

Having thus described various implementations of the present invention, it will be apparent to those skilled in the art that various changes may be made to the configuration, operation and form of the invention without departing from the spirit and scope thereof. The above description along with the illustrations should not be construed as limiting the invention to those implementations described or illustrated. Practitioners skilled in the art will recognize numerous other embodiments or implementations as well.

Further, the purpose of the Abstract of the Disclosure is to enable the U.S. Patent and Trademark Office and the public generally, and especially practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

What is claimed is:

1. A hair brush for styling hair, said hair brush comprising:

a) a brush head portion connected with a handle, said brush head portion comprising a cavity;

b) a cushion member engaged with said cavity of said brush head portion, said cushion member substantially filling said cavity and secured to maintain the position of said cushion member within said cavity and to prevent disengagement of said cushion member from said cavity with structure comprising i) said cavity comprising a set of opposing rails that project into said cavity and having at least one first set of sawtooth shaped ridges on each rail of said set of opposing rails, ii) said cushion member comprising a set of recessed channels on opposing sides of said cushion member, each recessed channel of said set of recessed channels comprising, within each recessed channel, at least one second set of sawtooth shaped ridges configured to interlock in a ratchet-type fashion with said at least one first set of sawtooth shaped ridges of said set of opposing rails of said cavity, and iii) engagement of said at least one first set of sawtooth shaped ridges of each rail of said cavity to said at least one second set of sawtooth shaped ridges of said recessed channel of said cushion member by sliding said cushion member into said cavity and passage of said at least one second set of sawtooth shaped ridges of said recessed channel past said at least one first set of sawtooth shaped ridges of said cavity;

c) a thermal plate comprising thermally conductive material engaged with said brush head portion and fixed in position preventing removal of said thermal plate from said brush head portion once engaged, said thermal plate assisting shaping, shining, and drying of hair when said thermal plate is heated and placed in contact with hair during hair styling with said hair brush;

d) said thermal plate and said cushion member structured and arranged such that said thermal plate substantially covers an upper surface of said cushion member and a gap is disposed between said upper surface of said cushion member and a lower surface of said thermal plate;

e) a plurality of hair brush bristles;

f) said cushion member and said thermal plate each comprising a plurality of openings; and g) said plurality of hair brush bristles are supported by said cushion member and pass through said plurality of openings in both said cushion member and said thermal plate so that the plurality of bristles extend upward.

2. The hair brush according to claim 1 wherein a) said cushion member comprises a centrally disposed bristle support portion and at least one side member flanking opposing sides of said bristle support portion and connected thereto with a living hinge so that said side members fold underneath said centrally disposed bristle support portion for engagement of said cushion member into said cavity; and b) each of said at least one side member comprises a recessed channel of said set of recessed channels; and c) said set of recessed channels are oriented to engage said set of opposing rails when said side members are folded underneath said centrally disposed bristle support portion.

3. The hair brush system according to claim 1, said thermal plate maintained in a fixed position above said cushion member to maintain said gap disposed between said upper surface of said cushion member and said lower surface of said thermal plate with structure comprising a set of slotted plate structures on opposing sides of said thermal plate, said set of slotted plate structures connected to said thermal plate and positioned beneath an uppermost surface of said thermal plate, and corresponding slots in each rail of said set of rails in said cavity that upon engagement form a joint characterized in that the plane of the slot of said set of slotted plate structures and of the slot in the rail of said set of rails are in perpendicular planes.

4. The hair brush according to claim 1 wherein said plurality of bristles are structured and arranged as at least one bristle bar, said at least one bristle bar comprising a base member with bristles extending away from said base, wherein said bristle bar is engaged with an under surface of said cushion member.

5. The hair brush according to claim 1 wherein said thermal plate comprises a metallic material.

6. The hair brush according to claim 5 wherein said metallic material comprises aluminum.

7. The hair brush according to claim 5 wherein said metallic material comprises copper.

8. The hair brush according to claim 5 wherein said thermal plate comprises a ceramic coating.

9. The hair brush according to claim 1 wherein said thermal plate comprises steel.

10. The hair styling brush according to claim 1 wherein said thermal plate comprises a ceramic coating.

11. The hair brush according to claim 1 wherein said brush head portion and said handle are integrally joined.

12. The hair brush according to claim 1 wherein said bristles comprise nylon.

13. The hair brush according to claim 1 wherein said handle comprises a grip-assisting element.

14. The hair brush system according to claim 1 wherein said upper surface of said cushion member comprises a convex profile and said thermal plate comprises a convex profile and wherein said convex profile of said thermal plate and said convex profile of said upper surface of said cushion member are similar.

15. A hair brush comprising:

a) a hair brush handle portion;

b) a hair brush head portion comprising a closed back portion and an open front portion, said open front portion comprising a top end and a bottom end and a pair of sidewalls comprising rails opposing one another that extend into an interior space of said open front portion and extend lengthwise along said brush head portion from said top end of said open front portion to said bottom end of said open front portion;

c) a plurality of bristle bars, each bristle bar comprising a plurality of bristles extending away from a bristle bar support, said plurality of bristles on each bristle bar support arranged in a row;

d) a resilient cushion member comprising an upper surface having a curvature and an under surface, said upper surface of said resilient cushion member comprising a plurality of openings arranged in rows, each row of said upper surface of said resilient cushion member configured to receive a bristle bar such that said bristle bar support contacts said under surface of said resilient cushion member and said plurality of bristles extend away from said upper surface of said cushion member, and said resilient cushion member comprises a pair of grooves that engage said pair of rails of said hair brush head;

e) a heat retention plate to assist shaping, shining, and drying hair when said heat retention plate is heated and placed in contact with hair during hair styling, said heat retention plate comprising a plurality of openings arranged in rows, each row of said plurality of rows of said heat retention plate configured to receive bristles from a bristle bar engaged with said resilient cushion member, a central portion, said central portion of said heat retention plate comprising a hair brush end and a handle end, that covers said upper surface of said resilient cushion member and comprising a curvature that corresponds to said curvature of said upper surface of said resilient rubber cushion, and side members on opposing sides of said central portion, each side member of said heat retention plate comprising a hair brush end and a handle end, that extend away from said central portion of said heat retention plate and engage and cover sides of said resilient cushion member that would otherwise be exposed when said heat retention plate is engaged with said resilient cushion member, and said handle end of said heat retention plate comprising a tongue-shaped arcuate end;

f) said hair brush head portion further comprising an inseparable shroud portion element that shrouds a portion of said handle end of said central portion of said heat retention plate and a portion of said handle end of said side members of said heat retention plate, said shrouding element comprising a semi-dome shaped structure comprising a curvature that corresponds to said curvature of said heat retention plate that corresponds to said curvature of said upper surface of said resilient rubber cushion, and said semi-domed shaped structure that extends above a bottom end of said open front portion of said hair brush head and transitions into a set of opposing sidewalls that transitions into and connects with said pair of sidewalls of said hair brush head portion, and said heat retention plate is exposed, including said side members on opposing sides of said central portion, except for those portions shrouded by said shrouding element, and those portions of said heat retention plate that are shrouded by said shrouding element are shrouded by sliding insertion of said resilient cushion member carrying said heat retention plate such that said tongue-shaped arcuate end of said heat retention plate slides into said semi-dome shaped structure and beneath said semi-dome shaped structure to secure said resilient cushion member carrying said heat retention plate by way of the curvature of said semi-dome shaped structure corresponding to the curvature of said heat retention plate, and the curvature of said resilient cushion member.

16. The hair brush according to claim 15 wherein said heat retention plate comprises a metallic material.

17. The hair styling brush according to claim 16 wherein said heat retention plate comprises a ceramic coating.

18. The hair brush according to claim 15 wherein said heat retention plate comprises a ceramic coating.

* * * * *